US007502042B2

(12) United States Patent
Hitz et al.

(10) Patent No.: US 7,502,042 B2
(45) Date of Patent: Mar. 10, 2009

(54) LASER DIODE THERMAL TRANSFER PRINTHEAD

(75) Inventors: Mark Hitz, Enterprise, FL (US); George Vazac, Apopka, FL (US); William Bouverie, Windermere, FL (US)

(73) Assignee: Datamax Corporation, Orlando, FL (US)

( * ) Notice: Subject to any disclaimer, the term of this patent is extended or adjusted under 35 U.S.C. 154(b) by 305 days.

(21) Appl. No.: 11/438,490

(22) Filed: May 22, 2006

(65) Prior Publication Data

US 2007/0257981 A1 Nov. 8, 2007

Related U.S. Application Data

(60) Provisional application No. 60/682,896, filed on May 20, 2005.

(51) Int. Cl.
*B41J 2/315* (2006.01)

(52) U.S. Cl. ..... 347/171

(58) Field of Classification Search ..... 347/171, 347/172, 175, 218, 233, 237, 238, 239
See application file for complete search history.

(56) References Cited

U.S. PATENT DOCUMENTS

| | | | |
|---|---|---|---|
| 4,019,935 | A | 4/1977 | Harvey |
| 4,082,595 | A | 4/1978 | Slater |
| 4,281,244 | A | 7/1981 | Murata et al. |
| 4,497,420 | A | 2/1985 | Stelcher et al. |
| 4,639,287 | A | 1/1987 | Sakura |
| 4,642,655 | A | 2/1987 | Sparer et al. |
| 4,680,080 | A | 7/1987 | Instance |
| 4,685,982 | A | 8/1987 | Kucheck |
| 4,691,100 | A | 9/1987 | Kizu et al. |
| 4,699,531 | A | 10/1987 | Ulinski, Sr. et al. |
| 4,732,502 | A | 3/1988 | Yokoi |
| 4,776,714 | A | 10/1988 | Sugiura et al. |
| 4,795,281 | A | 1/1989 | Ulinski, Sr. et al. |
| RE33,260 | E | 7/1990 | Stephenson |
| 5,067,832 | A | 11/1991 | Baur et al. |
| 5,103,259 | A | 4/1992 | Saitoh et al. |
| 5,133,396 | A | 7/1992 | Selak et al. |
| 5,195,837 | A | 3/1993 | Steppe et al. |
| 5,266,967 | A | 11/1993 | Maslanka et al. |

(Continued)

FOREIGN PATENT DOCUMENTS

| | | |
|---|---|---|
| DE | 2802104 B1 | 1/1978 |

(Continued)

OTHER PUBLICATIONS

Patent Abstracts of Japan JP04-112063, Apr. 14, 1992.

(Continued)

*Primary Examiner*—K. Feggins
(74) *Attorney, Agent, or Firm*—Carter, DeLuca, Farrell & Schmidt, LLP

(57) ABSTRACT

A thermal transfer printhead is disclosed. The printhead includes a backplane having one or more one connector receptacles. The printhead also includes one or more modules each of which includes a connector adapted to interface with the connector receptacles. The modules also include a laser diode array having laser diodes. The module interfaces with the backplane at a predetermined angle with respect to a printing direction and pitch to achieve a desired printhead density.

15 Claims, 7 Drawing Sheets

U.S. PATENT DOCUMENTS 5,320,437 A 6/1994 Malke et al.
5,336,003 A 8/1994 Nagashima et al.
5,344,248 A 9/1994 Schoon et al.
5,438,349 A 8/1995 Fox et al.
5,448,281 A 9/1995 Walter et al.
5,486,063 A 1/1996 Fox et al.
5,507,583 A 4/1996 Beaty et al.
5,534,890 A 7/1996 Krug et al.
5,563,686 A 10/1996 Beaufort et al.
5,564,845 A 10/1996 Yamaguchi et al.
5,570,962 A 11/1996 Suzuki et al.
5,587,728 A 12/1996 Edgar
5,588,761 A 12/1996 Seib
5,613,790 A 3/1997 Miazga
5,619,240 A 4/1997 Pong et al.
5,650,730 A 7/1997 Herbst, Jr.
5,653,846 A 8/1997 Onodera et al.
5,657,066 A 8/1997 Adams et al.
5,693,931 A 12/1997 Wade
5,707,162 A 1/1998 Kasai et al.
5,725,719 A 3/1998 Szczepaniec et al.
5,735,617 A 4/1998 Wirth
5,766,389 A 6/1998 Brandon et al.
5,802,973 A 9/1998 Mueller et al.
5,820,279 A 10/1998 Lodwig et al.
5,823,692 A 10/1998 Tolrud et al.
5,872,585 A 2/1999 Donato et al.
5,977,533 A 11/1999 Clayton
5,978,004 A 11/1999 Ehrhardt
6,030,133 A 2/2000 Endo
6,201,255 B1 3/2001 Torchalski et al.
6,202,727 B1 3/2001 Yisha et al.
6,231,253 B1 5/2001 Henderson et al.
6,326,989 B1 * 12/2001 Kohno et al. ..... 347/200
6,394,676 B1 5/2002 Dresher
6,396,070 B1 5/2002 Christensen et al.
6,616,362 B2 9/2003 Bouverie et al.
6,660,992 B2 12/2003 Yang
6,975,344 B2 * 12/2005 Okazaki ..... 347/238

FOREIGN PATENT DOCUMENTS

EP 0195949 A2 2/1986
EP 0798122 A2 1/1997

OTHER PUBLICATIONS

International Search Report dated Jul. 7, 2008.

* cited by examiner

LASER DIODE THERMAL TRANSFER PRINTHEAD

PRIORITY CLAIM

The present application claims priority to U.S. Provisional Application Ser. No. 60/682,896 entitled "LASER DIODE PRINTHEAD" filed by Mark Hitz on May 20, 2005.

BACKGROUND

1. Field of the Disclosure

The present disclosure relates to thermal transfer printing, more specifically, to a modular printhead having one or more laser diode modules.

2. Description of the Related Art

Currently, there are a variety of printing techniques to transfer ink or toner to a sheet of paper, such as liquid and solid ink printing, toner laser printing, dye-sublimation printing and thermal transfer printing. In the case of thermal printing, a thermal printhead provides thermal energy to specific locations of thermal-reactive printing media such as a thermal transfer ribbon or specifically treated medium (e.g., paper). Generally, a thermal printhead has a plurality of independently controllable heating elements which, when activated, heat the transfer ribbon and transfer thermally reactive inks or dyes from the ribbon to the paper or directly heat the medium treated with reactive inks. During this process, the heating elements cause the ink to sublimate into a gaseous state for a brief period. The amount of ink transferred to the medium, and hence, the ink saturation or tone depends on the temperature of the heating elements.

Conventional thermal transfer printheads are known in the art and utilize resistive heating elements disposed on an integrally formed structure. There is a need for a modular printhead adapted to be used with any number of modules to provide for increased versatility. Further, there is a need for a thermal transfer printhead utilizing different types of heating elements.

SUMMARY OF THE INVENTION

A thermal transfer printhead is disclosed which includes one or more modules having an array of laser diodes. The laser diodes emit a beam of focused light energy which heats dyes disposed near or at print media thereby depositing the dyes on the media and producing printed output. By varying the amount of laser diodes in the arrays, the amount of modules and the arrangement and/or position of the modules, i.e., angle with respect to printing direction and pitch, printhead density can be adjusted to a desired level. Namely, print resolution can be varied accordingly by modifying the angle and pitch of the modules.

According to one aspect of the present disclosure a thermal transfer printhead is disclosed. The printhead includes a backplane having one or more one connector receptacles. The printhead also includes one or more modules each of which includes a connector adapted to interface with the connector receptacles. The modules also include a laser diode array having laser diodes. The module interfaces with the backplane at a predetermined angle with respect to a printing direction and pitch to achieve a desired printhead density.

According to another aspect of the present disclosure a thermal transfer printhead module is disclosed. The module includes a connector adapted to interface with a connector receptacle. The module also includes a laser diode array having one or more one laser diodes. The module interfaces with the connector receptacle at a predetermined angle with respect to a printing direction and pitch to achieve a desired printhead density.

BRIEF DESCRIPTION OF THE DRAWINGS

The above and other aspects, features, and advantages of the present disclosure will become more apparent in light of the following detailed description when taken in conjunction with the accompanying drawings in which.

DESCRIPTION OF THE PREFERRED EMBODIMENTS

Preferred embodiments of the present disclosure will be described herein below with reference to the accompanying drawings. In the following description, well-known functions or constructions are not described in detail to avoid obscuring the present disclosure in unnecessary detail.

It should be appreciated by those skilled in the art that the various embodiments according to the present disclosure may be adapted for use in a plurality of printing systems and that the illustrated embodiment involving a thermal printing system is used for illustrative purposes.

Figure 1:
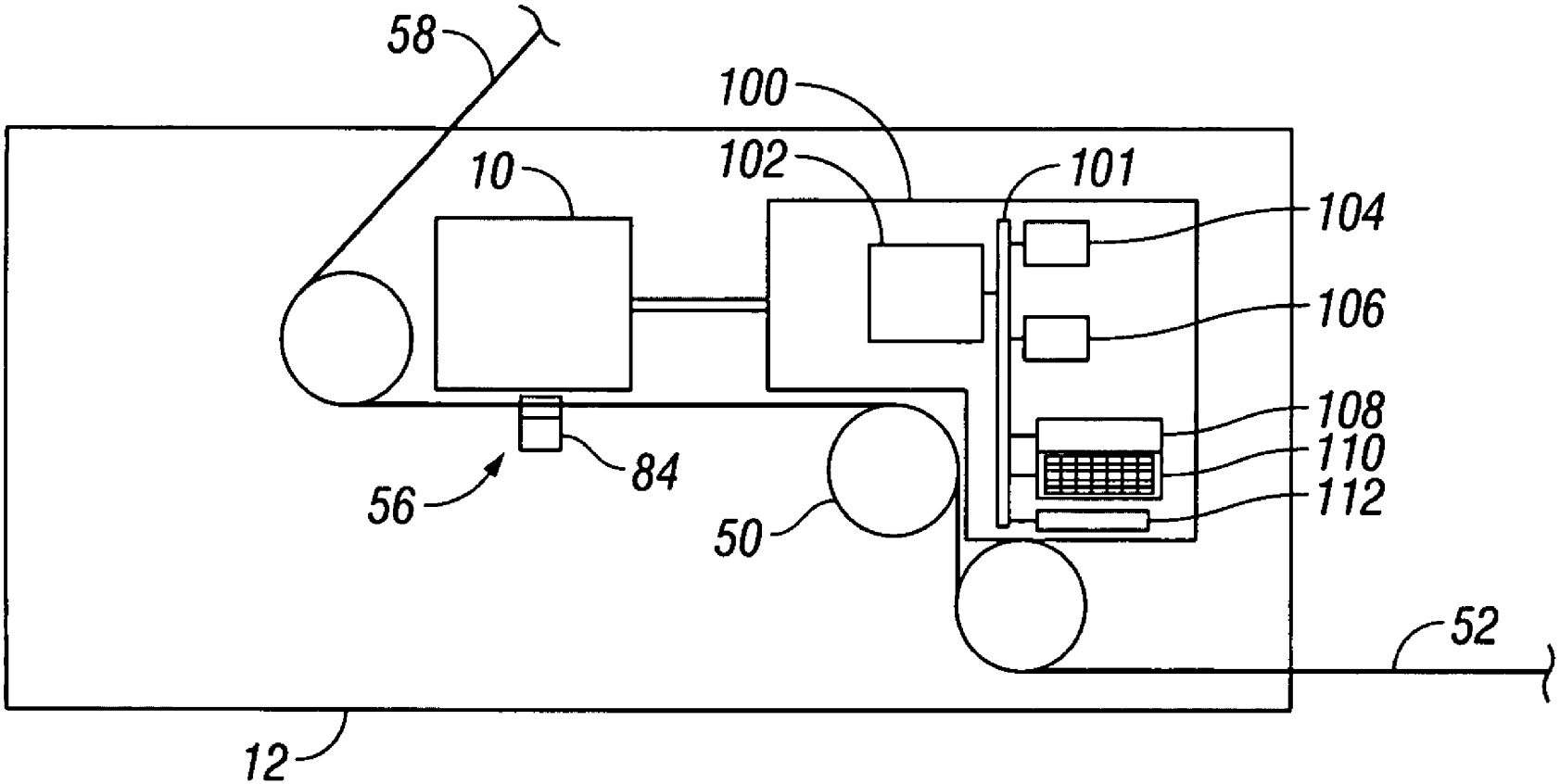
FIG. 1 is a block diagram of a thermal printer according to the present disclosure.

Referring to FIG. 1, a thermal printer 12 is shown including a controller assembly 100 having a processor 102, a random access memory (RAM) 104, a read only memory (ROM) 106 and input/output (I/O) interface(s) such as a keypad 110, a and display device 108. Furthermore, the printer 12 a communication network. In addition, various other peripheral devices may be connected to the thermal printer 12 by various interfaces and bus structures, such as a parallel port, serial port or universal serial bus (USB) (not explicitly shown). A system bus 101 may be included which couples the various components and may be any of several types of bus structures including a memory bus or memory controller, a peripheral bus, and a local bus using any of a variety of different bus architectures.

The printer 12 may also be configured to include an operating software and micro instruction code. The various processes and functions described herein may either be part of the micro instruction code, firmware, or part of the application program (or a combination thereof) which is executed via the operating system. In addition, the thermal printer 12 may be designed to include software for displaying user input screens and recording user responses as discussed in more detail below.

It is to be further understood that because some of the constituent system components and method steps depicted in the accompanying figures may be implemented in software, the actual connections between the system components (or the process steps) may differ depending upon the manner in which the present disclosure is programmed. Given the teachings of the present disclosure provided herein, one of ordinary skill in the related art will be able to contemplate these and similar implementations or configurations of the present disclosure.

The processor 102 is primarily used to perform operational tasks required for printing and controlling a printhead 10, a ribbon system 54, and a media system 50, consisting of guide ramps, feed rollers, sensors, motors, etc. The media system 50 transports printer media 5 (e.g., sheets of paper, labels, cards, etc.) from an input port 52 through a printing area 56 where the ribbon system 54 passes a thermal transfer ribbon (not shown) between the printhead 10 and the media. The dyes deposited on the ribbon are heated by the printhead 10 and are sublimated on the media to generate a print output, according to the output commands and data received from the control assembly 100. The printed media 5 is thereafter transported by the media system 50 through an output port 58. It envisioned that the print media 5 may be treated with dyes thereby making the ribbon system 54 optional. When treated print media 5 is used, the printhead 10 heats the dyes deposited on the media 5 directly to generate printed output.

Figure 2:
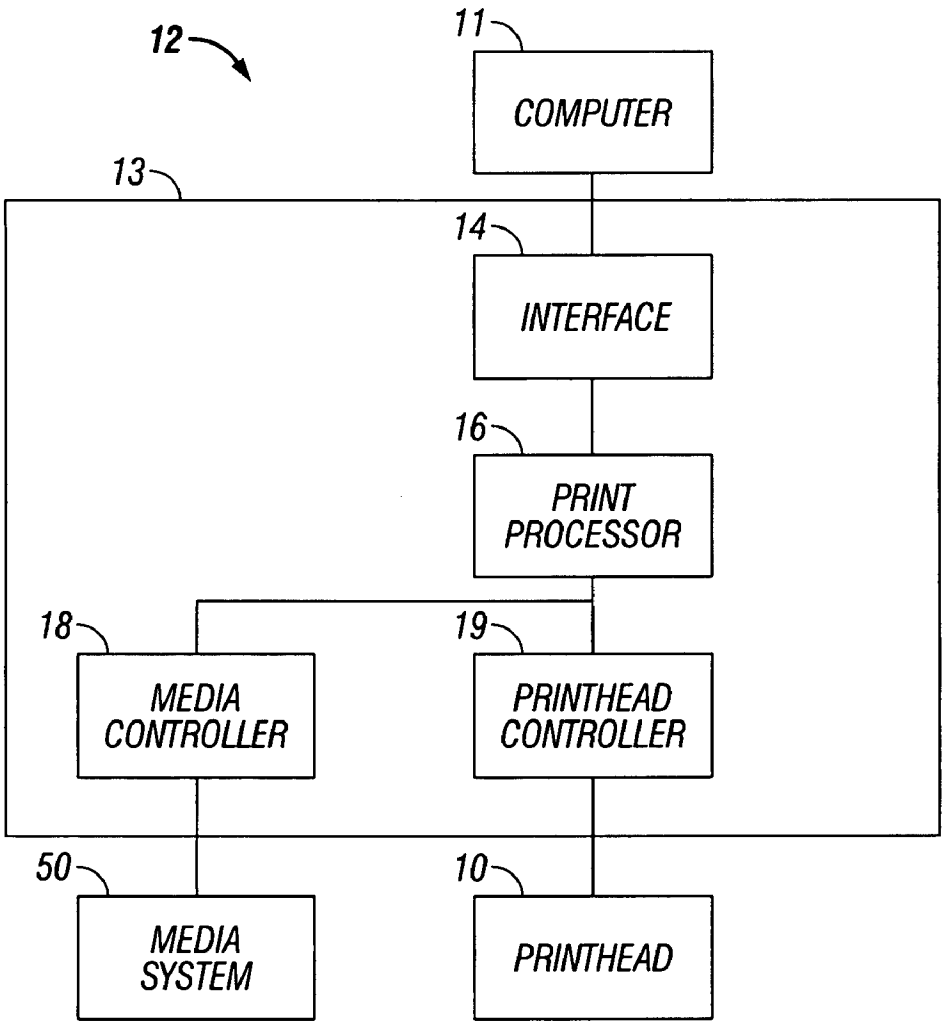
FIG. 2 is a flow diagram of a print engine of the thermal printer of FIG. 1 according to the present disclosure.

FIG. 2 shows a flow diagram of a print engine 13 for printing content. The printer engine 13 may be a software module stored within the controller assembly 100. The printer engine 13 receives data for output (e.g., images and/or text, etc.) from a computing device 11 or other data source through an interface 14 configured to accept and process incoming data and/or commands. The printer engine 13 also includes a print processor 16 for controlling the operation of the printer engine 13. The print processor 16 interfaces with a media controller 18 and a printhead controller 19. The media controller 18 controls the media system 50 and its components which may include guide ramps, feed rollers, sensors, motors, etc. Furthermore, the media controller 18 monitors the progress of the media 5 through the printer 12. The print processor 16 controls the printhead 10 through the printhead controller 18 by adjusting the heat generated the printhead 10 (e.g., amount of laser light being focused on the media 5). In addition, the printhead controller 18 communicates with the printhead 10 to create and/or read printing profile and generate and store usage data.

Figure 3:
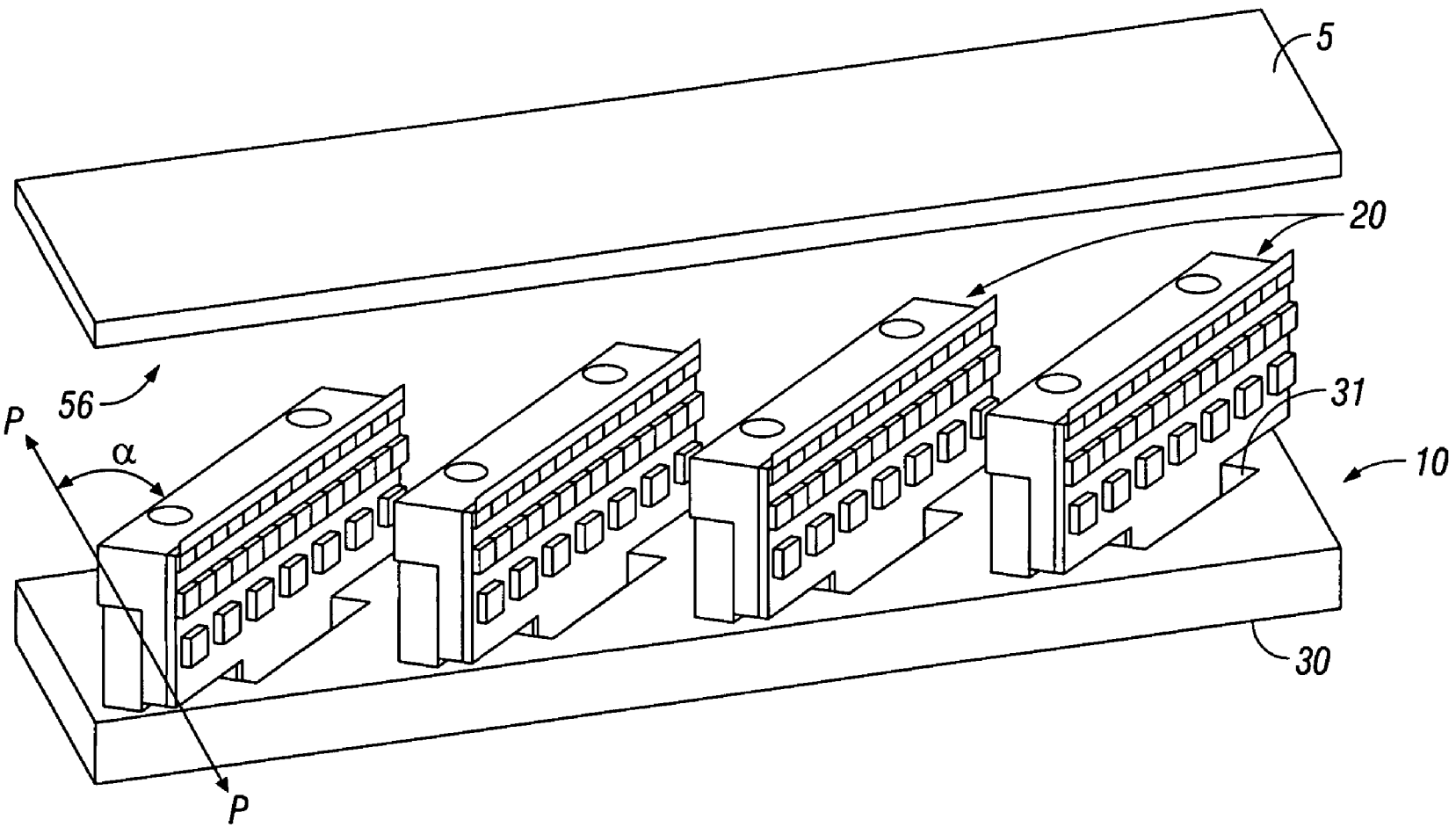
FIG. 3 is a perspective view of a thermal printhead according to the present disclosure.

FIG. 3 shows the printhead 10 including one or more printhead modules 20 disposed on a backplane 30. The printhead 10 is positioned in the printing area 56 a predetermined distance from the print media 5. The modules 20 are arranged parallel to each other at a predetermined angle $\alpha$ and pitch with respect to printing direction P. The printing direction P represents the vector along which either the media 5 and/or the printhead 10 are moved to generate the printed output. Rotating the modules 20 at the predetermined angle allows for adjustment of channels per millimeter of spacing of the media 5.

Figure 4:
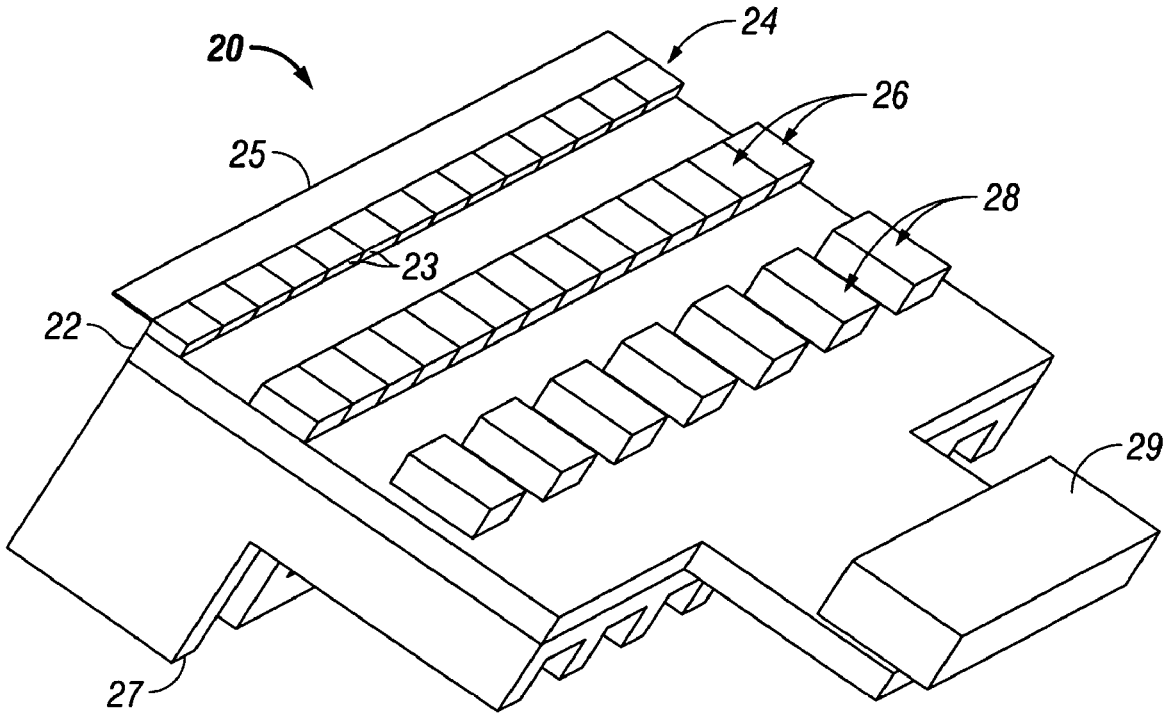
FIG. 4 is a perspective view of a printhead module according to the present disclosure.

FIG. 4 shows the module 20 which includes a laser diode array 24 having one or more laser diodes 23, laser diode drivers 26, a lens window 25, a control circuit, such as an application specific integrated circuit (ASIC) 28, a connector 29, and a heatsink 27 disposed on a substrate 22. Laser diodes 23 emit a focused beam of energy (e.g., visible or infrared light) which heats the media 5 directly or the ribbon to sublimate the dyes and deposit them on the media 5 as printed output. Each laser diode 23 produces dots (e.g., pixels) on the media 5 which taken together comprise the printed output. Adjusting the number of laser diodes 23 in the laser array 24 and/or the angle at which the module 20 and are disposed with respect to the printing direction P, controls the resolution of the printed output. In particular, the number of laser diodes 23, their position, pitch, and angle directly relate to the number of channels per millimeter of spacing on the media 5.

In one embodiment, the laser diode array 24 includes 16 laser diodes per array. When arranged at a 45° angle, the laser diode array 24 pitch forms a projected eight channels per millimeter spacing. Arranging the array having 16 laser diodes 23 at other angles allows the laser diode array 24 to form 12, 16 and 24 channels per millimeter of spacing.

The lens window 25 is mounted on the face of the module 20 between the media 5. The lens window 25 focuses the beam of light from each laser diode 23 to form a narrow image. The lens window 25 may be mounted on the face of the printhead 10 or individually on each of the modules 20.

Each of the laser diodes 23 has a corresponding laser diode driver 26 which controls the current flow through the laser diodes. The current powers the semiconductor materials of the laser diodes 23 to produce a focused beam of light. The laser diode drivers 26 are controlled by the ASICs 28. In particular, the ASICs 28 control the timing and firing of the laser diodes 23. The ASICs 28 processes the data from the printer 12 (e.g., print processor 16, printhead controller 19) and determine how to pulse (e.g., timing and firing) the laser diodes 23. This is further aided via a programmable process through a pulse code modulation (PCM) channel which determines the duty cycle for each laser diode during the on-time. A channel circuit is also used to set the calibration value of the output current to the laser diode 23 during setup (e.g., assembly at factory). The channel circuit also includes logic to control dot on/off information. Determining and controlling the on-time adjusts the intensity of the produced dot, which is equivalent to gray-scale control in monochrome printing. The ASICs 28 also set the mode of the modules 20 for transferring various types of data through the printhead 10. Further, the ASICs 28 provide soft power control which is a programmable process for reducing current surges.

The heatisink 27 is bonded to the substrate 22 using a variety of methods (e.g., glue, mechanical fasteners, etc.). The heatsink 27 absorbs the heat generated by the module 20 during operation. The heatsink 27 is formed from metal to ensure good heat conductivity and has one or more flat surfaces in contact with the substrate 22 to ensure good thermal contact. Further, the heat sink 27 includes an array of comb or fin like protrusions to increase the surface area exposed to the air, and thus increase the rate of heat dissipation. A fan or other mechanisms for providing air flow may also be added to provide for more efficient cooling.

The connector 29 secures the module 20 to the backplane 30 as well as provides electrical connection to the printhead 10. The connector 29 may include one or more conducting strips disposed on the substrate 22. This provides for interfacing of the modules 20 with the printhead 10. In particular, appropriate voltages and currents are provided to the modules 20 through the connectors 29. The backplane 30 includes one or more connector receptacles 31 which are adapted to interface with corresponding connectors 29 as shown in FIG. 3

Figure 5A:
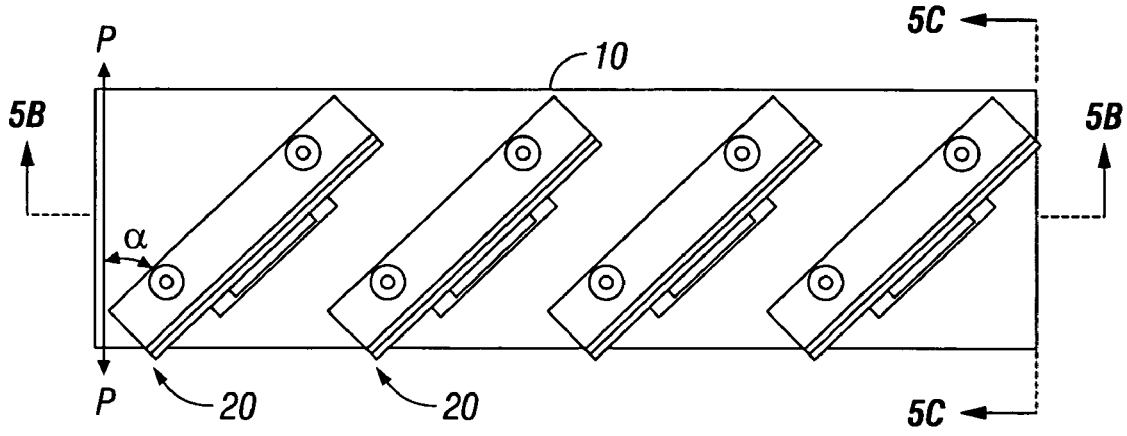
FIGS. 5A-5C are views of the printhead of FIG. 3 according to the present disclosure.
Figure 5B:
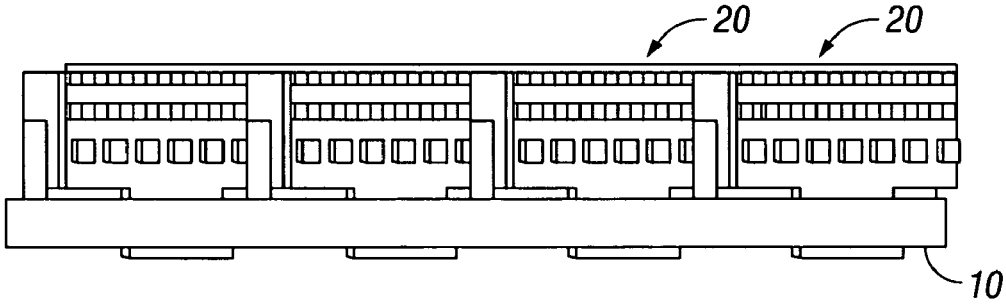
Figure 5C:
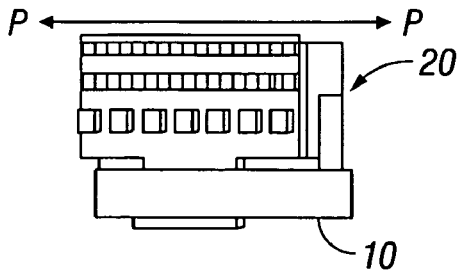
Figure 6A:
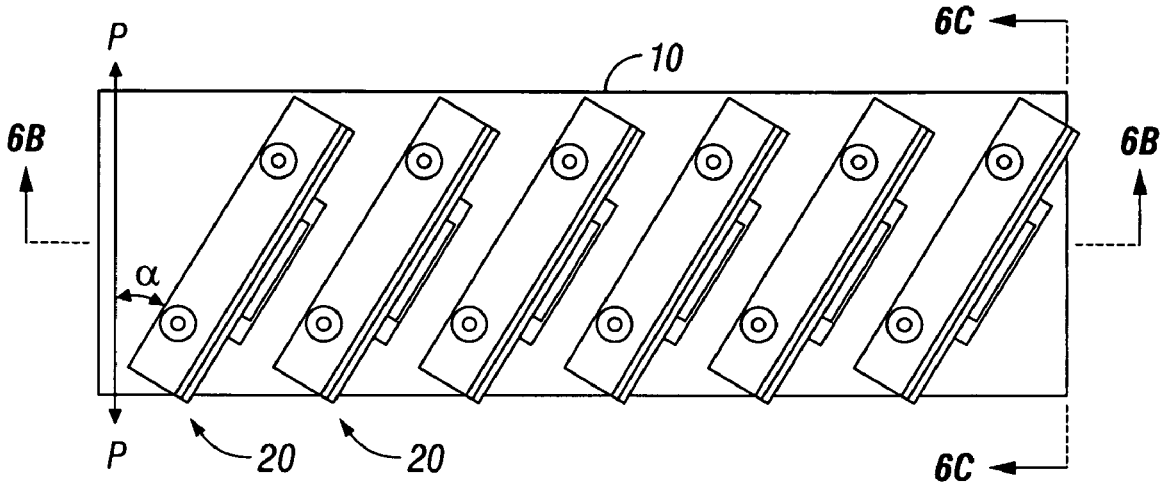
FIGS. 6A-6C are views of one embodiment of the printhead according to the present disclosure.
Figure 6B:
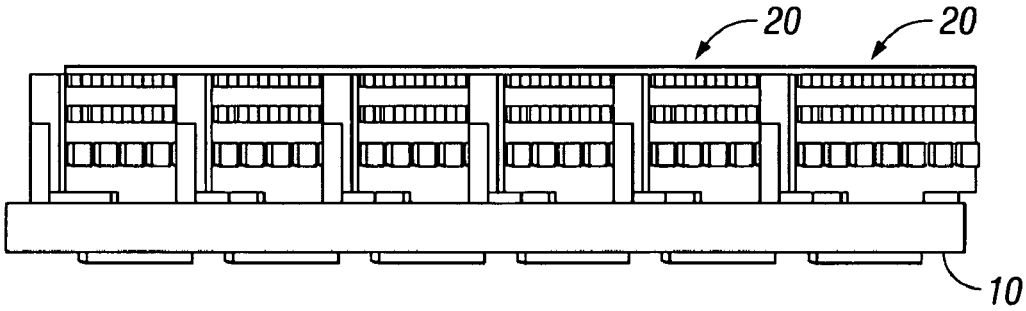
Figure 6C:
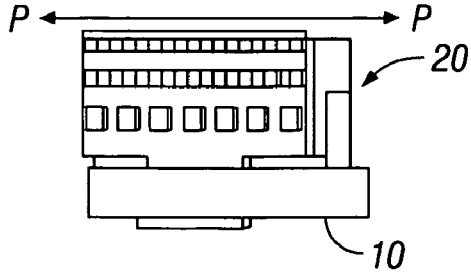
Figure 7A:
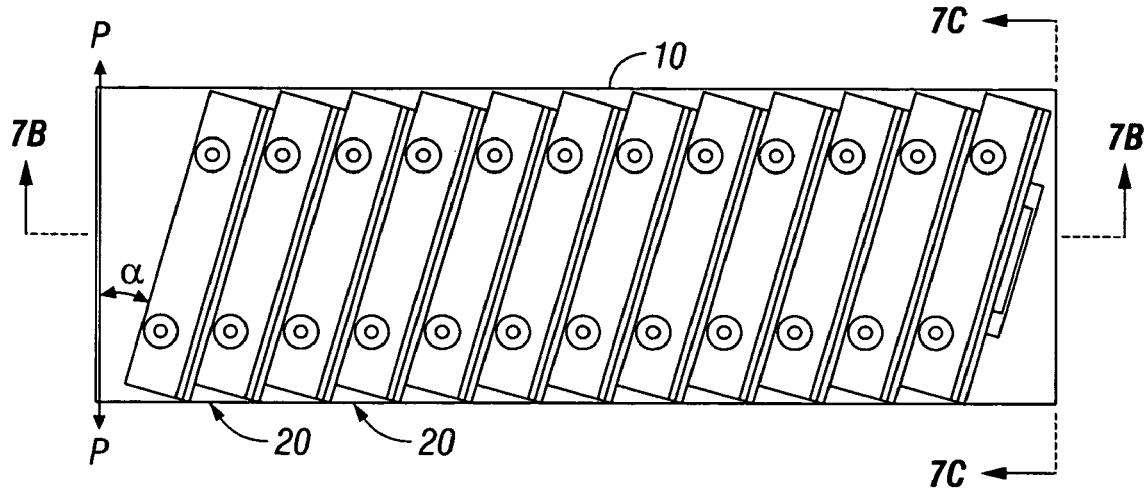
FIGS. 7A-7C are views of another embodiment of the printhead according to the present disclosure.
Figure 7B:
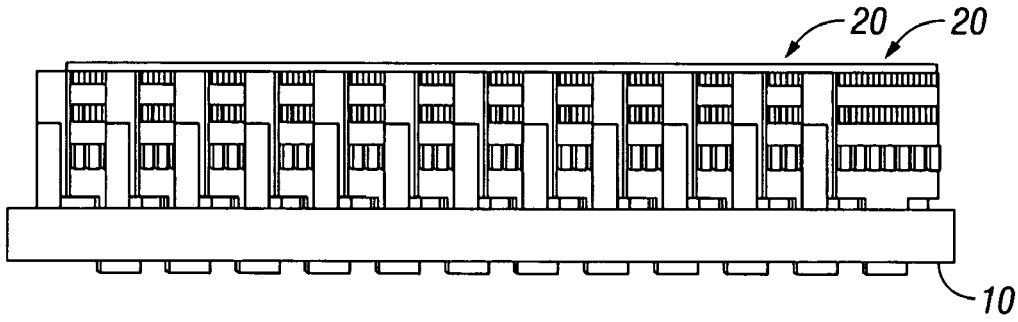
Figure 7C:
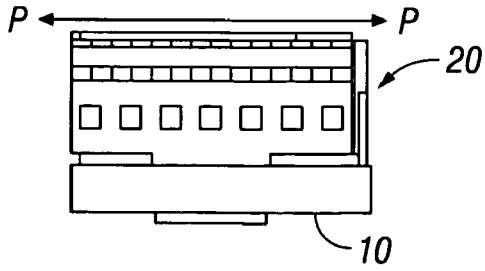

FIGS. 5-7 show various embodiments of the printhead 10. As discussed above, arranging the modules 20 at various angles and pitches allows for adjustment of printhead densities (e.g., resolution). FIGS. 5A-5C show a printhead 10 having four modules 20. The modules 20 are arranged at approximately a 45° angle with respect to the printing direction P which provides for a 203 DPI printhead. FIGS. 6A-C shows a printhead 10 having six modules 20 arranged at approximately a 30° allowing for 300 DPI resolution. Those skilled in the art will appreciate that the printhead 10 may include any number of modules 20 arranged at various angles and pitches as shown in FIGS. 7A-7C wherein the printhead 10 includes twelve modules 20.

The modules 20 are arranged on the printhead 10 in such a manner so as to ensure that there are no gaps on the media 5 between the modules. Namely, that the laser diodes 23 from multiple modules 20 disposed on the printhead 10 form a continuous projection on the media 5. The modules 20 interface with the backplane 30 at predetermined angles and pitches to achieve desired printhead densities (e.g., resolution).

Printhead density directly corresponds to the number of modules 20 included in the printhead 10, the higher the number of the modules 20 the higher is the printhead density and the resulting resolution. Resolution is also increased by changing the angle at which the modules 20 are arranged. The smaller the angle $\alpha$ (e.g., the closer the module 20 is rotated toward the printing direction P) the higher is the number of channels projected per unit of spacing of the media 5. The printhead 10 of FIGS. 7A-7C has the highest printhead density of printheads shown in FIGS. 5A-5C and 6A-6C since the printhead 10 has the largest number of modules 20 and the modules 20 are arranged at a small angle. In contrast, the printhead 10 of FIGS. 5A-5C only has four modules 20 which are arranged at larger angle than the printhead 10 shown in FIGS. 6A-6C and 7A-7C. This results in a lower DPI resolution.

The described embodiments of the present disclosure are intended to be illustrative rather than restrictive, and are not intended to represent every embodiment of the present disclosure. Various modifications and variations can be made without departing from the spirit or scope of the disclosure as set forth in the following claims both literally and in equivalents recognized in law.

What is claimed is:

1. A thermal transfer printhead comprising:

a backplane including at least one connector receptacle;

a plurality of modules each of which includes a connector adapted to interface with the at least one connector receptacle and a laser diode array having a plurality of laser diodes, each of the laser diodes adapted to project a channel onto a print media, wherein the at least one module interfaces with the backplane at a predetermined angle with respect to a printing direction and pitch to project a predetermined number of channels per unit of spacing of the print media.

2. A thermal transfer printhead as in claim 1, wherein the plurality of modules are arranged parallel to each other.

3. A thermal transfer printhead as in claim 1, wherein each of the modules further includes a laser diode driver adapted to control current flow through the at least one laser diode.

4. A thermal transfer printhead as in claim 1, wherein each of the modules further includes a heatsink.

5. A thermal transfer printhead as in claim 1, further comprising at least one lens window adapted to focus beam of light from the at least one laser diode.

6. A thermal transfer printhead as in claim 1, wherein each of the modules further includes a control circuit adapted to control timing of firing of the at least one laser diode.

7. A thermal transfer printhead as in claim 6, wherein the control circuit is further adapted to determine duty cycle for the at least one laser diode and to control gray scale of a dot produced by the laser diode as a function of the duty cycle.

8. A thermal transfer printhead module comprising:

a connector adapted to interface with at least one connector receptacle; and a laser diode array having a plurality of laser diodes, each of the laser diodes adapted to project a channel onto a print media, wherein the at least one module interfaces with the backplane at a predetermined angle with respect to a printing direction and pitch to project a predetermined number of channels per unit of spacing of the print media.

9. A thermal transfer printhead module as in claim 8, wherein the at least one connector receptacle is disposed on a backplane of a thermal transfer printhead.

10. A thermal transfer printhead module as in claim 9, wherein the backplane includes a plurality of connector receptacles and at least other module, wherein the thermal transfer modules are arranged parallel to each other.

11. A thermal transfer printhead module as in claim 8, further comprising a laser diode driver adapted to control current flow through the at least one laser diode.

12. A thermal transfer printhead module as in claim 8, wherein the module further includes a heatsink.

13. A thermal transfer printhead module as in claim 8, further comprising at least one lens window adapted to focus beam of light from the at least one laser diode.

14. A thermal transfer printhead module as in claim 8, further comprising a control circuit adapted to control timing of firing of the at least one laser diode.

15. A thermal transfer printhead module as in claim 14, wherein the control circuit is further adapted to determine duty cycle for the at least one laser diode and to control gray scale of a dot produced by the laser diode as a function of the duty cycle.

* * * * *